US010927326B2

(12) United States Patent
Toshida et al.

(10) Patent No.: US 10,927,326 B2
(45) Date of Patent: Feb. 23, 2021

(54) COSMETIC BRUSH CLEANER

(71) Applicant: SHISEIDO COMPANY, LTD., Tokyo (JP)

(72) Inventors: Ayano Toshida, Kanagawa (JP); Akira Matsuo, Kanagawa (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 19 days.

(21) Appl. No.: 16/319,440

(22) PCT Filed: Aug. 3, 2017

(86) PCT No.: PCT/JP2017/028227

§ 371 (c)(1),
(2) Date: Jan. 21, 2019

(87) PCT Pub. No.: WO2018/030268

PCT Pub. Date: Feb. 15, 2018

(65) Prior Publication Data

US 2019/0218481 A1 Jul. 18, 2019

(30) Foreign Application Priority Data

Aug. 10, 2016 (JP) ..... JP2016-157917

(51) Int. Cl.

| | |
|---|---|
| ***C11D 7/50*** | (2006.01) |
| ***C11D 7/26*** | (2006.01) |
| ***C11D 7/24*** | (2006.01) |
| ***C11D 17/04*** | (2006.01) |
| *C11D 11/00* | (2006.01) |

(52) U.S. Cl.
CPC ..... *C11D 7/261* (2013.01); *C11D 7/24* (2013.01); *C11D 7/242* (2013.01); *C11D 7/26* (2013.01); *C11D 17/04* (2013.01); *C11D 11/0017* (2013.01); *C11D 17/041* (2013.01)

(58) Field of Classification Search
CPC ..... A01N 25/02; C11D 7/50
USPC ..... 514/724; 424/405; 510/405
See application file for complete search history.

(56) References Cited

U.S. PATENT DOCUMENTS

| | | | | |
|---|---|---|---|---|
| 9,439,841 | B2 * | 9/2016 | Wegner | A61K 8/042 |
| 2004/0009886 | A1 | 1/2004 | Bryson | |
| 2011/0232681 | A1 | 9/2011 | Hatfield | |
| 2012/0208894 | A1 * | 8/2012 | Kampf | A61K 8/34 514/724 |

FOREIGN PATENT DOCUMENTS

| | | | |
|---|---|---|---|
| JP | S5513711 | A | 1/1980 |
| JP | H09028775 | A | 2/1997 |
| JP | H10168498 | A | 6/1998 |
| JP | H11124599 | A | 5/1999 |
| JP | 2001089800 | A | 4/2001 |
| JP | 2002241263 | A | 8/2002 |

OTHER PUBLICATIONS

International Search Report dated Sep. 5, 2017 filed in PCT/JP2017/028227.

* cited by examiner

*Primary Examiner* — Gregory E Webb
(74) *Attorney, Agent, or Firm* — Rankin, Hill & Clark LLP

(57) ABSTRACT

[Problem] To provide a cosmetic brush cleaner excellent in quick dryability and capable of removing stains such as deposited cosmetics with ease in the following manner: impregnating tissue paper, towel, or the like with the cleaner to wipe off the cosmetics, sebum, and the like deposited on a cosmetic brush; or directly spraying the cleaner on a cosmetic brush, and wiping the brush with dry tissue paper or the like.

[Solution] A cosmetic brush cleaner including: (A) a lower alcohol in an amount of 30 to 99 mass %; (B) a volatile oil in an amount of 1 to 70 mass %; and (C) water in an amount of 7 mass % or less (including 0 mass %).

3 Claims, No Drawings

COSMETIC BRUSH CLEANER

TECHNICAL FIELD

The present invention relates to a cosmetic brush cleaner for removing stains such as cosmetics and sebum deposited on a cosmetic brush.

BACKGROUND ART

A cosmetic brush widely used for applying cosmetics such as foundation to the face is often cleaned in water or lukewarm water, or by adding a neutral detergent thereto in order to remove stains such as cosmetics and sebum deposited due to use.

However, when the brush is continuously kept with moisture held in the bristle tufts thereof for a long time after cleaning with water or the like, microorganisms and molds are generated, and an offensive smell is caused. These and other factors not only give discomfort feeling in another use, but also pose a hygiene problem. Further, when the surfactant included in the neutral detergent remains in the bristle tufts of the brush, the bristle tufts become sticky. This makes it difficult to apply cosmetics. Further, when the brush after cleaning is left stand in an inappropriate state, the bristle tufts of the brush is bent or twisted during drying, resulting in deformation. Thus, when cosmetics are applied with the cosmetic brush again, the contact feeling to skin is bad, which makes it difficult to apply cosmetics, and also makes it impossible to sufficiently obtain the cosmetic effect.

On the other hand, when hot air is blown to the bristle tufts using a dryer or the like in order to speed up drying of the cosmetic brush, the bristle tufts of the brush are damaged. This results in a remarkable decrease in life of the cosmetic brush, and a loss of soft touch which the bristle tufts inherently have. Accordingly, the cosmetic behavior becomes uncomfortable, and it becomes difficult to uniformly apply cosmetics. For these reasons, it becomes difficult to obtain a sufficient cosmetic effect. Further, the behavior such as drying using a dryer requires much time in the first place, and hence is a burdensome behavior for a user.

For this reason, there is a desire to develop a cosmetic brush cleaner excellent in quick dryability and capable of removing stains such as deposited cosmetics with ease in the following manner: impregnating tissue paper, towel, or the like with the cleaner to wipe off the cosmetics, sebum, and the like deposited on a cosmetic brush; or directly spraying the cleaner on a cosmetic brush, and wiping the brush with dry tissue paper or the like.

CITATION LIST

Patent Literature

[PTL 1] Japanese Patent Application Publication No. 2002-241263

SUMMARY OF INVENTION

Technical Problem

An object of the present invention is to provide a cosmetic brush cleaner excellent in quick dryability and capable of removing stains such as deposited cosmetics with ease in the following manner: impregnating tissue paper, towel, or the like with the cleaner to wipe off the cosmetics, sebum, and the like deposited on a cosmetic brush; or directly spraying the cleaner on a cosmetic brush, and wiping the brush with dry tissue paper or the like.

Solution to Problem

The present inventors conducted a study in order to solve the problem. As a result, the present inventors found the following: by mixing a lower alcohol, a volatile oil, and water each in a predetermined amount, it is possible to obtain a cosmetic brush cleaner capable of removing the stains such as cosmetics deposited on a cosmetic brush with ease, and further, also excellent in quick dryability. This has led to the completion of the present invention.

Namely, the present invention is a cosmetic brush cleaner, including: (A) a lower alcohol in an amount of 30 to 99 mass %; (B) a volatile oil in an amount of 1 to 70 mass %; and (C) water in an amount of 7 mass % or less (including 0 mass %).

Further, the present invention is the cosmetic brush cleaner, wherein the lower alcohol (A) is ethanol or isopropyl alcohol.

Still further, the present invention is the cosmetic brush cleaner, wherein the volatile oil (B) is one or two or more selected from the group consisting of isododecane, isohexadecane, hydrogenated polyisobutene, cyclopentasiloxane, and dimethicone.

Moreover, the present invention is a cosmetic brush cleaning product including the cosmetic brush cleaner, wherein the cleaner is accommodated in a dispenser container.

Advantageous Effects of Invention

In accordance with the present invention, a cosmetic brush cleaner is impregnated into tissue paper, towel, or the like. Using this, the cosmetics, sebum, and the like deposited on a cosmetic brush are wiped off. As a result, the stains such as cosmetics deposited on the cosmetic brush can be removed with ease. Further, the quick dryability is also excellent. This can eliminate the necessity of performing an operation for drying.

Further, after directly spraying the cosmetic brush cleaner of the present invention to a cosmetic brush, the cosmetic brush is wiped by dry tissue paper, towel, or the like. This also can remove the stains such as cosmetics with ease.

Still further, a cosmetic brush is immersed in the cosmetic brush cleaner. Then, the cosmetic brush is wiped by dry tissue paper, or the like. This also can provide the same effect.

The cosmetic brush cleaner of the present invention does not require mixing of a surfactant therein. This can prevent remaining of a surfactant in the bristle tufts of a cosmetic brush, which can eliminate the occurrence of stickiness of the bristle tufts.

DESCRIPTION OF EMBODIMENTS

A cosmetic brush cleaner of the present invention includes: (A) a lower alcohol in an amount of 30 to 99 mass %; (B) a volatile oil in an amount of 1 to 70 mass %; and (C) water in an amount of 7 mass % or less (including 0 mass %).

(A) Lower Alcohol

The lower alcohols for use in the present invention have no particular restriction so long as they are commonly used for cosmetics, and one or two or more thereof can be used.

As the lower alcohols, C2 to C10 straight chain or branched, saturated or unsaturated, monohydric or polyhydric aliphatic alcohols can be used. For example, mention may be made of ethanol, isopropyl alcohol, 1,2-propylene glycol, dipropylene glycol, 1,3-butyrene glycol, 1,2-pentanediol, hexylene glycol, glycerin, sorbitol, 1,2,3-butanetriol, 1,2,3-pentanetriol, and 1,2,3,4-pentanetetrol, and isomers thereof. Among these, ethanol and isopropyl alcohol are particularly preferable because of excellence in the drying speed after cleaning the cosmetic brush, and the effect of reducing the offensive smell of the brush.

The mixing amount of lower alcohol is set at 30 mass % or more. The reason for this is as follows: when the content of lower alcohol is too small, the volatile oil to be mixed is not dissolved, and is separated into two layers; as a result, the stains such as the cosmetics and sebum deposited on a cosmetic brush may not be sufficiently removed.

(B) Volatile Oil

As the volatile oil for use in the present invention, mention may be made of low-boiling-point hydrocarbon oil, silicone oil, or the like with a boiling point under ordinary pressure within the range of 60° C. to 260° C.

As the volatile hydrocarbon oil, either of straight chain or branched one may be used. As such volatile hydrocarbon oils, mention may be made of isodecane, isododecane, isohexadecane, hydrogenated polyisobutene (soft liquid isoparaffin), and the like.

As the volatile silicone oils, for example, mention may be made of chain polysiloxanes such as dimethylpolysiloxane (Dimethicone), methylphenylpolysiloxane, and methyl hydrogen polysiloxane, and cyclic polysiloxanes such as octamethylcyclotetrasiloxane, decamethylcyclopentasiloxane, dodecamethylcyclohexasiloxane, and tetramethyltetrahydrogen cyclotetrasiloxane. Further, as the product examples thereof, for example, there are KF96L-0.65, KF96L-1, KF96L-1.5, and KF995 manufactured by Shin-Etsu Chemical Co., Ltd., SH200-1cs, SH200-1.5cs, and SH200-2cs manufactured by Dow Corning Toray Silicone Co., Ltd., and TSF404, TSF405, and TSF4045 manufactured by Toshiba Silicones Ltd.

(C) Water

The cosmetic brush cleaner of the present invention can contain water in an amount of 7 mass % or less (including 0 mass %). As a result, it becomes possible to appropriately add a sequestrant, a stabilizer, an antiseptic, a UV absorber, an antioxidant, and aqueous components such as aqueous agents. When the content of water is too large, the volatile oil is separated, which may make difficult uniform application to a cosmetic brush.

The cosmetic brush cleaner of the present invention can be kept in a uniform state without separation of a volatile oil while keeping the quick dryability when the amount of water is 7 mass % or less based on the total amount even if water is mixed therein. As a result, even when water penetrates from the junction part of a container accommodating the cosmetic brush cleaner therein, or moisture passes through the resin forming the container, and is mixed therein, the volatile oil will not be separated, and the quality of the cosmetic brush cleaner can be held with stability for a long period. This enables continuation of repeated use at the lavatory rest room or the bathroom.

When the cosmetic brush cleaner is accommodated in a dispenser container, a prescribed amount of the cosmetic brush cleaner can be applied to a cosmetic brush without staining hands. This enables still easier removal of the stains such as the deposited cosmetics. As the dispenser containers, those of a type of spraying the contents in a mist form, those of a type of discharging the contents still in a liquid form, and the like can be appropriately selected and adopted.

EXAMPLES

Below, the present invention will be described in more details by taking concrete examples, which are construed as not limiting the technical range of the present invention at all. Incidentally, the content in the following examples, and the like is by mass % unless otherwise specified.

Each cosmetic brush cleaner obtained by the formulations shown in Tables 1 and 2 was evaluated. For evaluation, the state immediately after manufacturing, the functionalities regarding the cleaning effect, the quick dryability, and being free from stickiness upon wiping off each cosmetic brush after application of foundation by tissue paper impregnated with each cosmetic brush cleaner, and further the long-term stability (the state after an elapse of three weeks) under humidified conditions (98% RH) at 37° C. were evaluated.

The evaluation criteria are as follows.

<Evaluation Criteria> a: very excellent (pass), b: excellent (pass), c: a little excellent (pass), d: a little inferior (fail), e: inferior (fail)

TABLE 1

| | Component | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| (A) Lower alcohol | Ethanol | 99 | 97 | 95 | 90 | | 90 | 30 | 86 | 85 | 83 |
| | Isopropyl alcohol | | | | | 90 | | | | | |
| (B) Volatile oil | Isododecane | 1 | 3 | 5 | 10 | 10 | | 70 | 9 | 5 | |
| | Isohexadecane | | | | | | | | | | 10 |
| | Hydrogenated polyisobutene | | | | | | 5 | | | | |
| | Cyclopentasiloxane | | | | | | | | | 5 | |
| | Dimethicone (silicone KF-96L-1.5CS) | | | | | | 5 | | | | |
| | Dimethicone (silicone KF-96A-6CS) | | | | | | | | | | |

TABLE 1-continued

| | Component | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| | Dimethicone (silicone KF-96-100CS) | | | | | | | | | | |
| (C) Water | Water | 0 | 0 | 0 | 0 | 0 | 0 | 0 | 5 | 5 | 7 |
| | Total | 100 | 100 | 100 | 100 | 100 | 100 | 100 | 100 | 100 | 100 |
| | Immediately after | | | | | | | | | | |
| Evaluation Results | State | a | a | a | a | a | a | a | a | a | a |
| | Functionality evaluation | | | | | | | | | | |
| | Cleaning effect | c | c | a | a | a | a | a | a | a | a |
| | Quick dryability | a | a | a | a | a | a | a | b | b | c |
| | Being free from stickiness | a | a | a | a | a | a | a | a | a | a |
| | Long-term stability (humidity simulation test) | | | | | | | | | | |
| | Contents stability | a | a | a | a | a | a | a | a | a | a |

Notes:
Silicone KF96L-1.5CS, Silicone KF96A-6CS, and silicone KF-96-100CS are all the trade names of the silicone oils manufactured by Shin-Etsu Chemical Co., Ltd.

Examples 3 to 7 could get evaluation of "a: very excellent (pass)" in all the evaluation items as shown in Table 1. Examples 1 and 2 show the results of "c: a little excellent (pass)" in the functionality evaluation regarding the cleaning effect, but "a: very excellent (pass)" in other evaluation items. Examples 8 to 10 show the results of "b: excellent (pass)" or "c: a little excellent (pass)" in the functionality evaluation regarding the quick dryability, but "a: very excellent (pass)" in other evaluation items.

From the description up to this point, the cosmetic brush cleaner is required to include (A) a lower alcohol in an amount of 30 to 99 mass %, (B) a volatile oil in an amount of 1 to 70 mass %, and (C) water in an amount of 7 mass % or less (including 0 mass %) in order to exhibit the functions as the cosmetic brush cleaner. In order to obtain a still more excellent cleaning effect, preferably, the content of the lower alcohol (A) is set at 30 to 95 mass %, and the content of the volatile oil (B) is set at 5 to 70 mass %. Further, in order to obtain a still more excellent quick dryability, preferably, the content of water (C) is set at less than 5 mass % (including 0 mass %).

Further, each cosmetic brush cleaner shown in Examples 1 to 10 does not require mixing of a surfactant therein. This can prevent the surfactant from being left in the bristle tufts of the cosmetic brush, which can eliminate the occurrence of stickiness of the bristle tufts.

TABLE 2

| | Component | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| (A) Lower alcohol | Ethanol | 81.5 | 99.9 | 20 | 90 | 90 | 78 |
| | Isopropyl alcohol | | | | | | |
| (B) Volatile oil | Isododecane | 5 | 0.1 | 80 | | | 10 |
| | Isohexadecane | | | | | | |
| | Hydrogenated polyisobutene | | | | | | |
| | Cyclopentasiloxane | 5 | | | | | |
| | Dimethicone (silicone KF-96L-1.5CS) | | | | | | |
| | Dimethicone (silicone KF-96A-6CS) | | | | 10 | | |
| | Dimethicone (silicone KF-96-100CS) | | | | | 10 | |
| (C) Water | Water | 8.5 | | | | | 12 |
| | Total | 100 | 100 | 100 | 100 | 100 | 100 |
| | Immediately after | | | | | | |
| Evaluation Results | State | a | a | a | a | e (separated) | e (separated) |
| | Functionality evaluation | | | | | | |
| | Cleaning effect | a | d | a | b | | |
| | Quick dryability | d | a | a | d | | |
| | Being free from stickiness | a | a | a | d | | |
| | Long-term stability (humidity simulation test) | | | | | | |
| | Contents stability | a | a | e (separated) | a | | |

As shown in Table 2, for each of Comparative Examples 5 and 6, the oil phase was not dissolved immediately after manufacturing, and the state separated into two layers was observed. Further, for Comparative Example 3, the separation was observed in the long-term stability test under humidified conditions. Still further, for each of Comparative Examples 1, 2, and 4, separation, or the like was not caused, and there was no problem in terms of properties. However, the result was "d: a little inferior (fail)" in some functionality evaluation regarding cleaning effect, quick dryability, and being free from stickiness.

The invention claimed is:

1. A cosmetic brush cleaner, comprising:

(A) a lower alcohol in an amount of 30 to 99 mass %;

(B) a volatile oil in an amount of 1 to 70 mass %, the volatile oil (B) being one or two or more selected from the group consisting of isododecane, hydrogenated polyisobutene, cyclopentasiloxane, and dimethicone; and (C) water in an amount of 7 mass % or less (including 0 mass %).

2. The cosmetic brush cleaner according to claim 1, wherein the lower alcohol (A) is ethanol or isopropyl alcohol.

3. A cosmetic brush cleaning product comprising the cosmetic brush cleaner according to any of claims 1 to 2, wherein the cleaner is accommodated in a dispenser container.

* * * * *